US006382157B1

(12) United States Patent
Yamauchi et al.

(10) Patent No.: US 6,382,157 B1
(45) Date of Patent: May 7, 2002

(54) VALVE TIMING CONTROL DEVICE

(75) Inventors: Makoto Yamauchi; Hiroyuki Kinugawa, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,080

(22) Filed: Jul. 6, 2001

(30) Foreign Application Priority Data

Jan. 30, 2001 (JP) ..... 2001-022361

(51) Int. Cl.[7] ..... F01L 1/34
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 4,570,334 A * 2/1986 Melzer et al. ..... 29/700
5,143,032 A * 9/1992 Tortul ..... 123/90.17
5,934,233 A * 8/1999 Auchter et al. ..... 123/90.17

FOREIGN PATENT DOCUMENTS

JP 9-280020 10/1997
JP 11-210422 8/1999

* cited by examiner

*Primary Examiner*—Weilun Lo
(74) *Attorney, Agent, or Firm*—Sughrue Mion, PLLC

(57) ABSTRACT

A valve timing control device has a case rotating in synchronization with a crankshaft of an engine. A plurality of projections, which project outwardly in a radial direction of the case, are arranged on an outer circumferential portion of the case at regular intervals. The projection is a chuck site allowing the engagement of a chuck tool of an automatic machine used for an auto-assembly work, the chuck tool being operated in the radial direction. A tapered face is formed at a side, close to the chuck tool, of the projection, the tapered face easily allowing the engagement of the chuck tool when the chuck tool proceeds toward the device.

12 Claims, 13 Drawing Sheets

VALVE TIMING CONTROL DEVICE

BACKGROUND OF THE INVENTION

1. Field of the Invention

The present invention relates to a valve timing control device for modifying the opening and closing timing of the intake and exhaust valves in an internal-combustion engine (hereafter, referred as an engine) according to any operating condition.

2. Description of the Prior Art

Conventional valve timing control devices are disclosed in JP-A-1997/280020 and JP-A-1999/210422, for example.

FIG. 1 is a perspective view of main points of the engine provided with the conventional valve timing control device mounted on an end of an intake camshaft. FIG. 2 is a lateral cross sectional view of an internal construction of the conventional valve timing control device of FIG. 1. FIG. 3 is a longitudinal cross sectional view taken along lines A—A of FIG. 2.

In the drawings, reference numeral 1 denotes a crankshaft (not shown) of the engine, and 2 denotes an intake camshaft integrated with a cam 3 controlling an open/close timing of an intake valve 4. 5 denotes an exhaust camshaft integrated with a cam 6 controlling an open/close timing of an exhaust valve 7. 8 denotes a valve timing control device (hereafter, referred as device) mounted fixedly at one end of the intake camshaft 2, 9 denotes a sprocket mounted fixedly at one end of the exhaust camshaft 5, and 10 denotes a sprocket mounted fixedly at one end of the crankshaft 1. 11 denotes a chain which acts as an endless transfer member wound around the sprocket 10, the sprocket 9 and a sprocket described later of the valve timing control device, turning clockwise (direction of arrow CW) in the drawings. A slit 2*a* is formed at the other end of the intake camshaft 2, and a slit 5*a* is formed at the other end of the exhaust camshaft 5. The slits 2*a* and 5*a* allow engagement of a positioning spacer 12 resulting an angle defined between the both camshafts.

Hereafter, the internal construction of the valve timing control device will be explained. In FIG. 2 and FIG. 3, 13 denotes a first rotor which connects with the crankshaft through the chain 11 to rotate in synchronization with the crankshaft 1. The first rotor 13 includes a sprocket 14 rotating in synchronization with the crankshaft 1, a case 15 having a plurality of shoes 15*a* which are projected from an inner portion of the case 15 to constitute a plurality of hydraulic pressure chambers, a cover 16 covering the hydraulic pressure chambers, and a threaded member 17 such as a bolt and so on integrating the sprocket 14 and the case 15 with the cover 16.

A rotor (second rotor) 18 is arranged within the case 15, and allows the relative rotation with respect to the first rotor 13. The rotor 18 is fixedly integrated with the intake camshaft 2, which relates to open/close operation of the intake valve 4, through a washer 19 by using a threaded member 20 such as a bolt and so on. The rotor 18 has a plurality of vanes 18*a* dividing the hydraulic pressure chambers, which are constituted by the shoes 15*a* of the case 15, into an advance side hydraulic pressure chamber and a retardation side hydraulic pressure chamber 22. Moreover, a first oil path 23 and a second oil path 24 are arranged within the intake camshaft 2. The first oil path 23 supplies hydraulic pressure to, and discharges a hydraulic pressure from the advance side hydraulic pressure chamber 21. The second oil path 24 supplies hydraulic pressure to, and discharges a hydraulic pressure from the retardation side hydraulic pressure chamber 22.

Seal means 25 are arranged on both of front ends of the shoes 15*a* of the case 15 and the vanes 18*a* of the rotor 18, respectively. The respective seal means 25 includes a seal member 25*a* for sliding on an inner wall face of the advance side hydraulic pressure chamber 21 or the retardation side hydraulic pressure chamber 22, and a plate spring 25*b* for biasing the seal member 25*a* toward the inner wall face.

An accommodation hole 26 is arranged at one of the shoes 15*a* of the case 15 acting as the first rotor 13. A lock pin 27 having a cylindrical shape is accommodated in the hole 26 to restrict relative rotation of the first rotor 13 and the second rotor 18. Incidentally, since hydraulic pressure in the valve timing control device is reduced on starting the engine, the rotor 18 vibrates in the rotational direction by a cam load applied to the cam 3 integrated with the intake camshaft 2. When the first and second rotors 13 and 18 repeat contact and separation, and beat noise (abnormal noise) necessarily results. The lock pin 27 prevents the occurrence of the beat noise (abnormal noise). The lock pin 27 also keeps a required angle between the first and second rotors 13 and 18 under low hydraulic pressure being difficult to control the angle. Therefore, the lock pin 27 is biased by an biasing member 28 such as coil springs to engage in an engagement hole will be explained later, the biasing member 28 being arranged between a rear wall of the accommodation hole 26 and the lock pin 27.

On the other hand, an engagement hole 29 is formed at the rotor 18 acting as the second rotor to allow insertion of the lock pin 27 when the first rotor 13 is positioned with respect to the rotor 18 at a required angle (maximum retardation).

A release valve 30 is arranged at the shoe 15*a*. The release valve 30 supplies selectively the higher hydraulic pressure in the advance side hydraulic pressure chamber 21 and the retardation side hydraulic pressure chamber 22 to a release hydraulic pressure chamber 99 to release engagement (hereafter, referred as lock) between the engagement hole 29 and the lock pin 27. The release valve 30 communicates with the release hydraulic pressure chamber 99 through a release hydraulic supply path 31. The release valve 30 and the advance side hydraulic pressure chamber 21 communicate with an advance side pressure partition path 32, and the release valve 30 and the retardation side hydraulic pressure chamber 22 communicate with a retardation side pressure partition path 33.

A recess 35 is formed at the rotor 18 acting as the second rotor to engage with a knock pin 34 which is arranged at one end of the intake camshaft 2 to define a relative rotation between the device 8 and the intake camshaft 2.

Next, a method of assembling the valve timing control device will be explained.

At first, the valve timing control device is arranged at one end of the intake camshaft 2. Here, the lock pin 27 is engaged with the engagement hole 29 to position fixedly the first rotor 13 of the device 8 and the rotor 18 acting as the second rotor at the required angle. The knock pin 34 of the intake camshaft 2 is further engaged with the recess 35 of the rotor 18 to position fixedly the intake camshaft 2 and the rotor 18, in other wards, to fix the device 8 at a required angle. The sprocket 14 is connected fixedly to the rotor 18 positioned at the required angle by the threaded member 20 to position fixedly the sprocket 14 and one end of the intake camshaft 2.

Next, the sprocket 9 is arranged at one end of the exhaust camshaft 5. Here, a knock pin (not shown) of the exhaust camshaft 5 is engaged with a recess (not shown) to position the exhaust camshaft 5 and the sprocket 9 at a required angle. The sprocket 9 is fixed to the one end of the exhaust camshaft 5 by a bolt (not shown).

Next, as shown in FIG. 1, a crank-fixing pin 36 is screwed into the crankshaft 1 from the outside of the engine to position the crankshaft 1 at the required angle. The positioning spacer 12 is inserted into the slit 2*a* of the intake camshaft 2 and the slit 5*a* of the exhaust camshaft 5 to regulate the angle defined between the both camshafts.

Next, the chain 11 is wound around the sprocket 10, the sprocket 9, and the sprocket 14, and is then held under a tension by a chain-tensioner (not shown) in order to prevent the slack of the chain 11. In this state, the sprocket 10 is fixed to the one end of the crankshaft 1 by the bolt (not shown).

However, the conventional valve timing control device having the construction above may display assembly errors in fitting the device on the engine resulting from looseness between the lock pin 27 and the engagement hole 29, between the knock pin 34 of the intake camshaft 2 and the recess 35 of the rotor 18, and between the knock pin (not shown) of the exhaust camshaft 5 and the recess (not shown) of the sprocket 9. Thus, there is a problem that a gear with respect to the intake camshaft 2 is not timed to a gear with respect to the exhaust camshaft 5.

SUMMARY OF THE INVENTION

Accordingly, it is an object of the present invention to provide a valve timing control device, which allows assembly with minimum numbers of errors and allows simple fitting into the engine.

In order to achieve the object of the present invention, a valve timing control device comprises a first rotor rotating in synchronization with a crankshaft of the engine, the first rotor having a plurality of shoes inside thereof; a second rotor fixed on an end of an intake camshaft or an exhaust camshaft of the internal combustion engine and arranged rotatably in the first rotor, the second rotor having a plurality of vanes on the outside; an advance side hydraulic pressure chamber and a retardation side hydraulic pressure chamber defined between the vanes of the second rotor and the shoes of the first rotor; a lock member locking the first and second rotors at a required angle which the second rotor forms with the first rotor; an engagement hole arranged at any one of the first and second rotors to allow insertion of the lock member; and a chuck site being chucked by a chucking tool used for fitting the actuator to the engine, which is arranged at least one on the first rotor or on the second rotor. Thus, the valve timing control device can be supported rotatably by the intake camshaft or the exhaust camshaft to do assembly with a minimum number of errors with respect to fitting the device to the engine. Moreover, a time lag in open/close timing of intake and exhaust valves can be resolved which allows simplification of assembly work, in particular auto-assembly work.

The chuck site may be arranged on the first rotor, allowing the engagement of the chucking tool operated in a radial direction of the first rotor. Thus, the device can be easily supported through the chuck site of the first rotor to perform the simplification of the auto-assembly work.

The chuck site may be arranged at an outer circumferential portion of the first rotor. Thus, since the chuck site is arranged at a position keeping a distance from an inner portion subjected to a hydraulic pressure, the first rotor can maintain high mechanical strength.

The chuck site may be arranged on the first rotor, allowed to insert the chucking tool which is operated in an axial direction of the first rotor. Thus, the device can be easily supported through the chuck site of the first rotor to perform the simplification of the auto-assembly work.

The chuck site may be a bolt head used for assembling the actuator. Thus, the device can be easily supported through the chuck site of the first rotor to perform the simplification of the auto-assembly work.

The chuck site may be arranged on the outer circumferential portion of the first rotor, and may have a polygonal shape. Thus, a simplification of the shape of the first rotor is possible. Since the chuck site is arranged at a position keeping a distance from an inner portion subjected to a hydraulic pressure, the first rotor can maintain high mechanical strength.

The chuck site may be arranged on the outer circumferential portion of the first rotor, and may include at least one plane. Thus, a simplification of the shape of the first rotor is possible. Moreover, the device can be easily supported through the chuck site of the first rotor to perform the simplification of the auto-assembly work.

The chuck site may support the first rotor or the second rotor in a rotational direction thereof. Thus, the device can be easily supported through the chuck site of the first rotor or the second rotor to simplify the auto-assembly work.

The chuck site may be arranged on the outer circumferential portion of the first rotor, and may have a groove to separate the chuck site from an endless transfer member transferring rotation of the crankshaft. Thus, the endless transfer member can keep from contact with the chuck site of the first rotor having a small radius.

The chuck site may be arranged on the inner circumferential portion of the second rotor, and has a polygonal shape. Thus, a time lag in open/close timing of valves owing to a threading torque can be resolved. Moreover, when the device above is arranged on one of the camshafts, a device having a chuck site arranged at a first rotor is arranged on the other to do assembly of the both devices with a minimum number of errors with respect to fitting the respective devices to the engine.

The chuck site may be arranged on the second rotor, allowing the engagement of the chucking tool operated in a radial direction of the second rotor. Thus, a time lag in open/close timing of valves owing to a threading torque can be resolved. Moreover, when the device above is arranged on one of camshafts, a device having a chuck site arranged at a first rotor is arranged on the other to do assembly of the both devices with a minimum number of errors with respect to fitting the respective devices to the engine.

The chuck site may be arranged on the second rotor, allowed to insert the chucking tool which is operated in an axial direction of the second rotor. Thus, a time lag in open/close timing of valves owing to a threading torque can be resolved. Moreover, when the device above is arranged on one of camshafts, a device having a chuck site arranged at a first rotor is arranged on the other to do assembly of the both devices with a minimum number of errors with respect to fitting the respective devices to the engine.

DESCRIPTION OF THE PREFERRED EMBODIMENT OF THE INVENTION

Hereafter, one embodiment according to the present invention will be explained.

Embodiment 1

Figure 2:
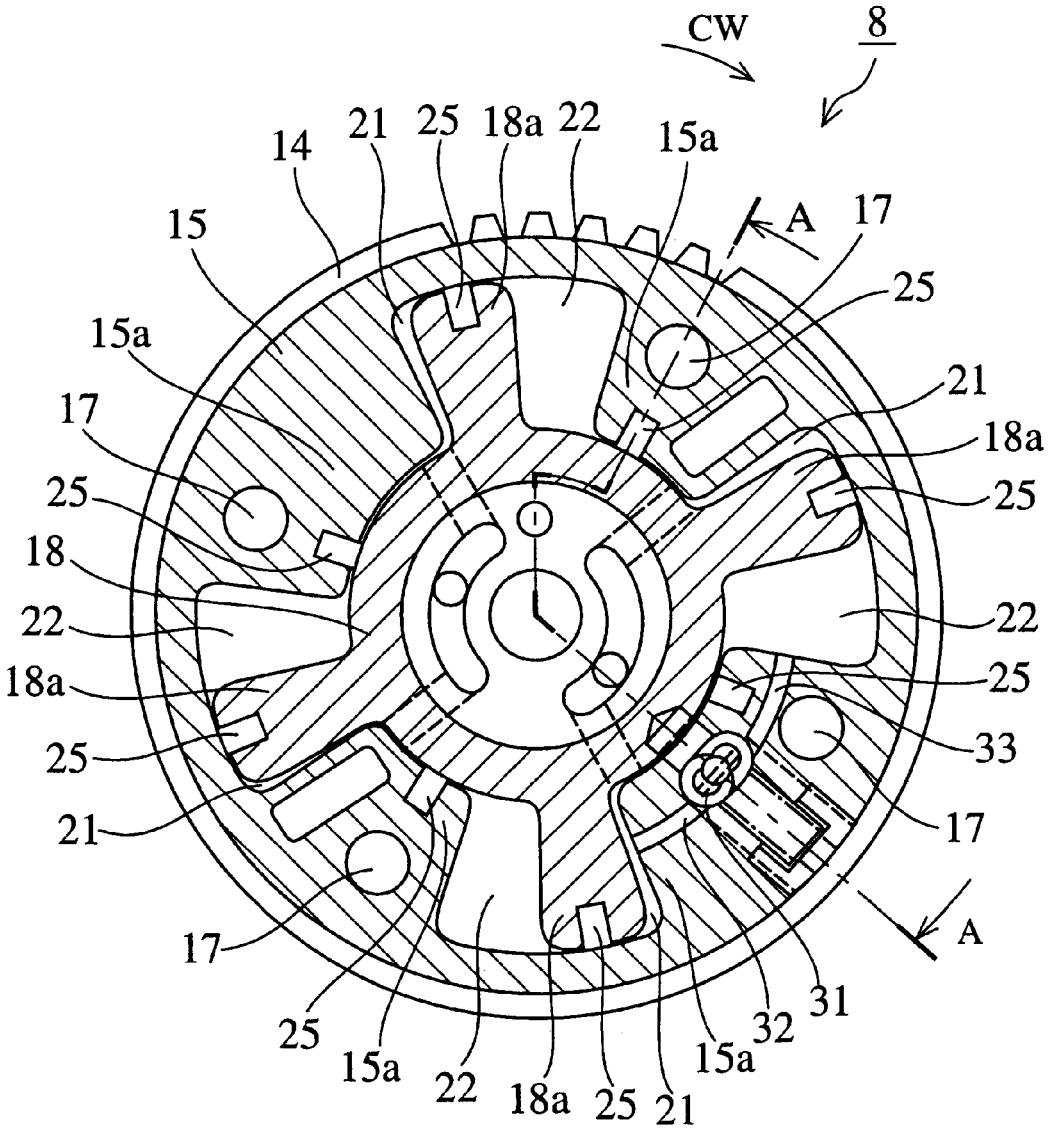
FIG.2 (PRIOR ART)
FIG. 2 is a lateral cross sectional view of an internal construction of the conventional valve timing control device of FIG. 1.
Figure 3:
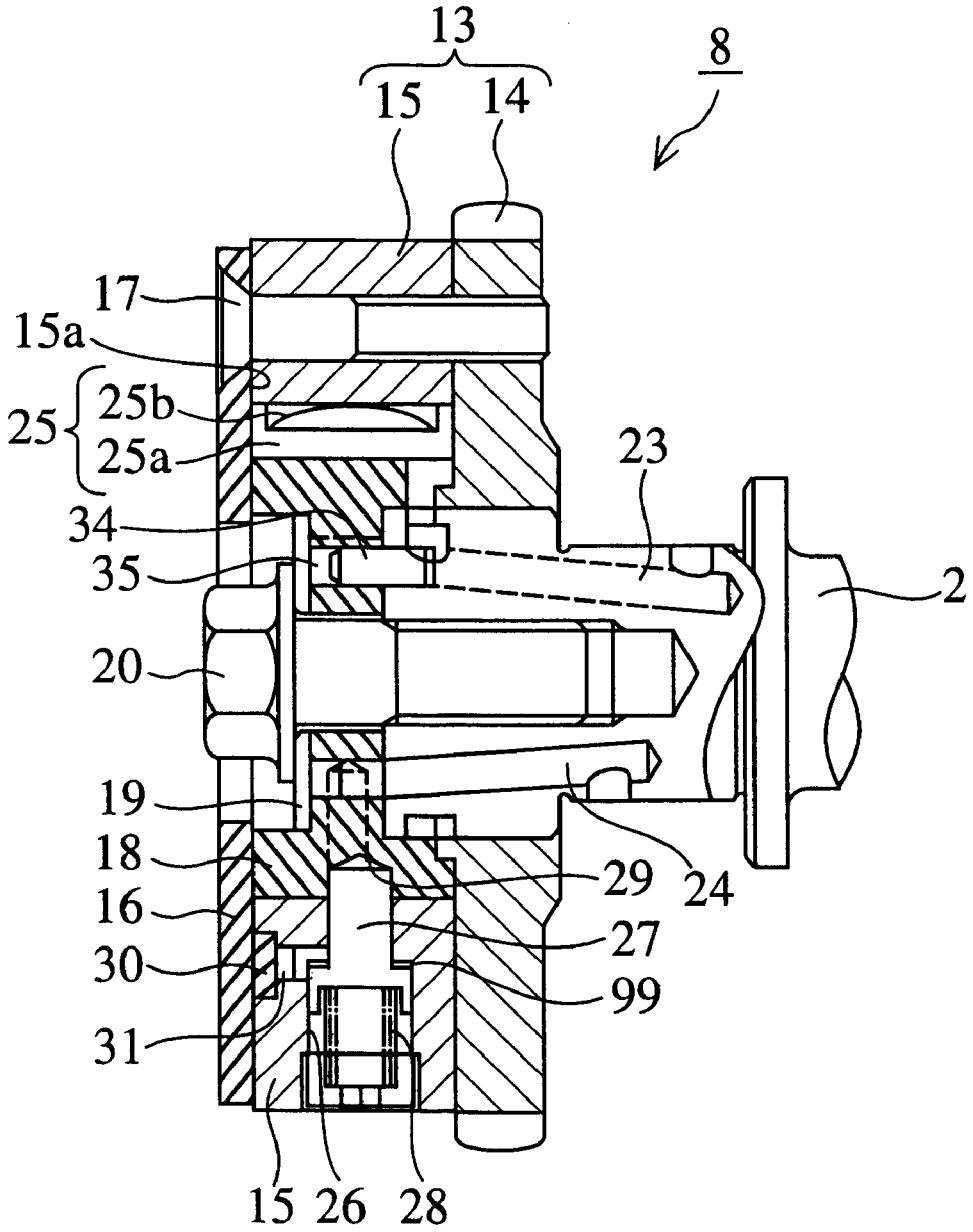
FIG.3 (PRIOR ART)
FIG. 3 is a longitudinal cross sectional view taken along lines A—A of FIG. 2.
Figure 4:
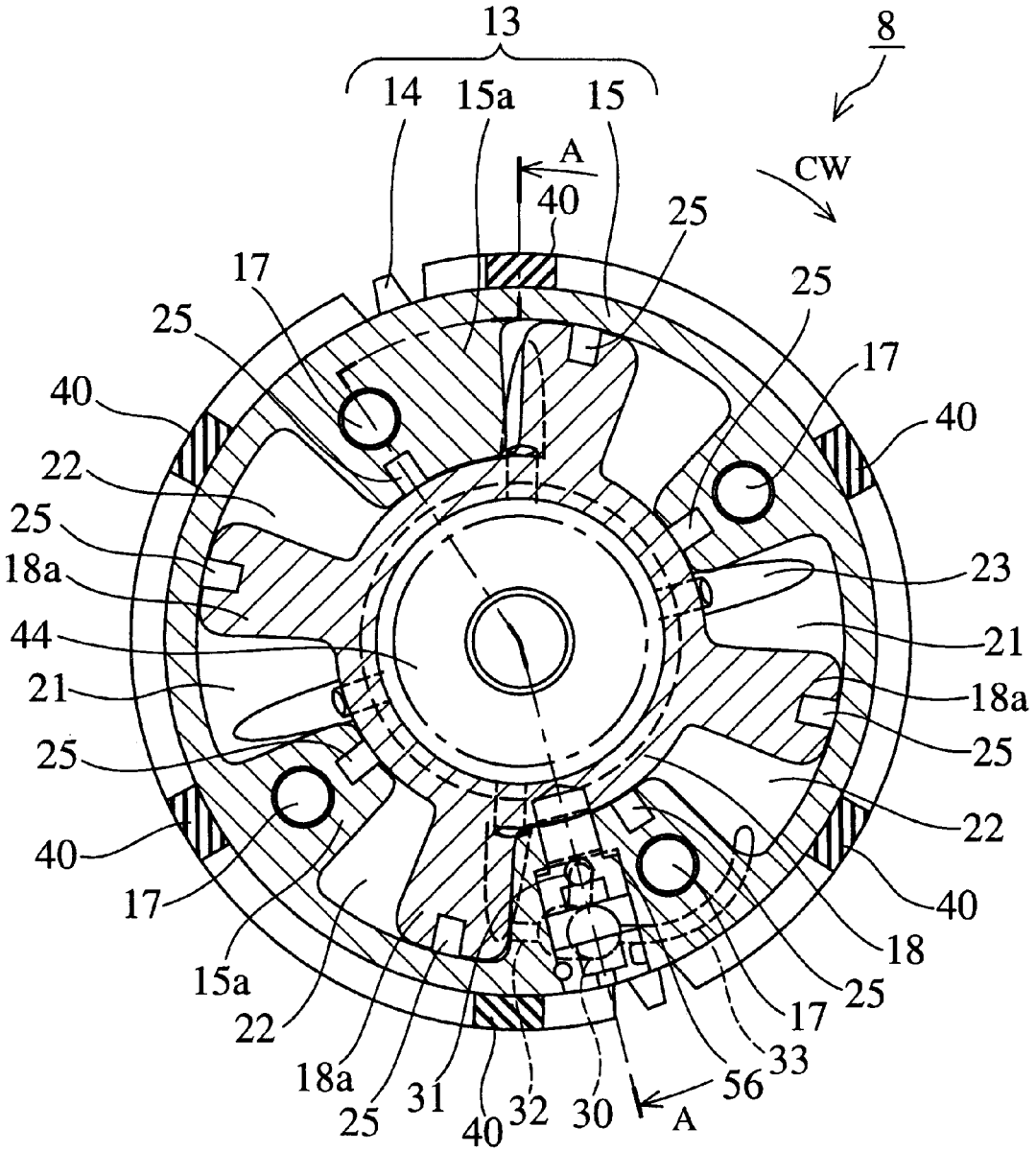
FIG. 4 is a lateral cross sectional view of an internal construction of a valve timing control device as embodiment 1 according to the present invention.
Figure 5:
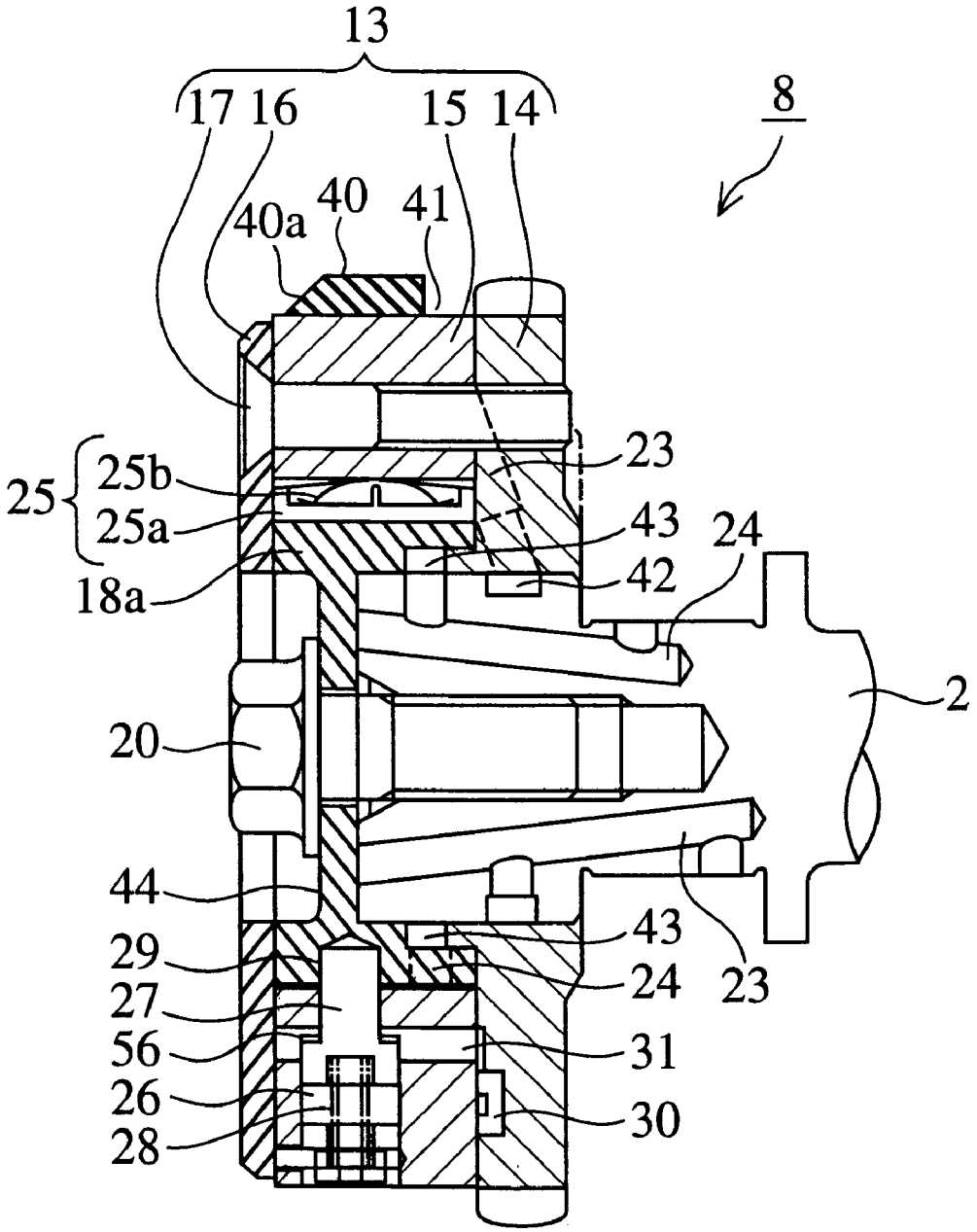
FIG. 5 is a longitudinal cross sectional view taken along lines A—A of FIG. 4.
Figure 6:
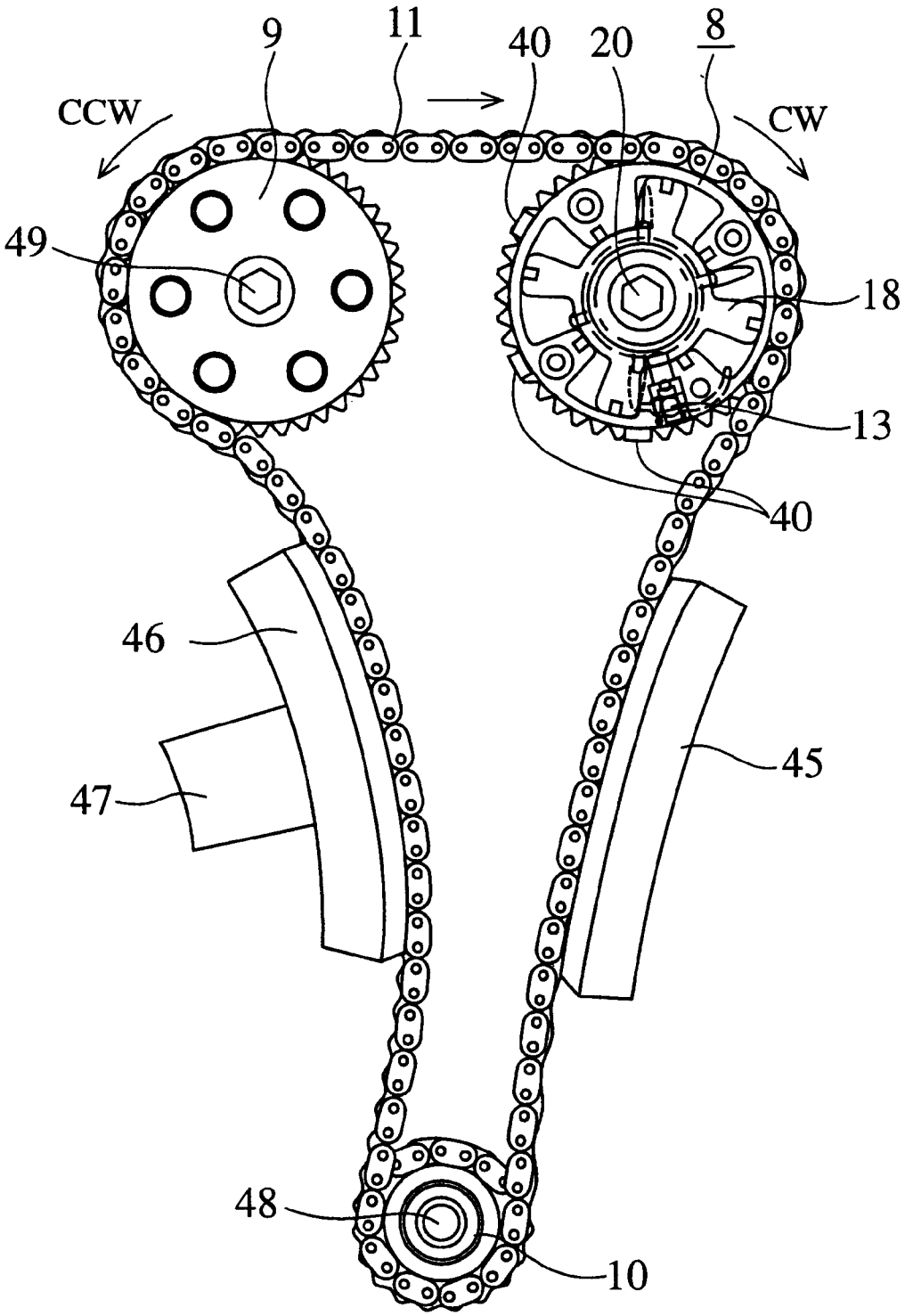
FIG. 6 is a front view of main points of an engine, whose intake camshaft provided with the valve timing control device of FIG. 4 and FIG. 5.

FIG. 4 is a lateral cross sectional view of an internal construction of a valve timing control device as embodiment 1 according to the present invention. FIG. 5 is a longitudinal cross sectional view taken along lines A—A of FIG. 4. FIG. 6 is a front view of main points of an engine, whose intake camshaft provided with the valve timing control device of FIG. 4 and FIG. 5. In the drawings, since the common numerals of the embodiment 1 denote common elements in the conventional structure of FIGS. 1 to 3, the description of such parts is omitted.

The embodiment 1 is characterized in that positioning, using the conventional knock pin, of the intake camshaft 2 and the rotor 18 acting as the second rotor, and of the exhaust camshaft 5 and the sprocket 9 is withdrawn. The embodiment 1 is further characterized in that a plurality (in the embodiment 1, six parts) of projections (chuck site) 40 projecting outwardly in the radius direction of the case 15 are arranged at an outer circumferential portion (outer portion) at regular intervals.

The projection 40 allows the engagement of a chuck tool of an automatic machine used for an auto-assembly work, the chuck tool being operated in the radial direction. A tapered face 40*a* is formed at a side, close to the chuck tool, of the projection 40, the tapered face 40*a* easily allowing the engagement of the chuck tool when the chuck tool proceeds from a left hand of FIG. 5 toward the device 8. As shown in FIG. 5, a clearance groove 41 is defined between the sprocket 14 and the projection 40 on the outer circumferential portion of the case 15 to separate the projection 40 from the chain 11 wound the sprocket 14.

A first toroidal oil path 42 is formed in the intake camshaft 2 to communicate the first oil path 23 with the advance side hydraulic pressure chamber 21. When the device 8 positions with respect to the intake camshaft 2 at any angle, hydraulic pressure can be supplied to or discharged from the advance side hydraulic pressure chamber 21. A second toroidal oil path 43 is formed at an engagement position between the rotor 18 and the sprocket 14 to communicate the second oil path 24 with the retardation side hydraulic pressure chamber 22. When the device 8 positions with respect to the intake camshaft 2 at any angle, hydraulic pressure can be supplied to or discharged from the retardation side hydraulic pressure chamber 22.

With the embodiment 1, a concave seat 44 used for seating the threaded member 20 fixing the rotor 18 to the intake camshaft 2 has an inner cylindrical face. With the embodiment 1, the release valve 30 is arranged at the sprocket 14. The release valve 30 supplies a hydraulic pressure, acting against the biasing force of the biasing member 28, to a release hydraulic pressure chamber 56 through the release hydraulic supply path 31 to release the lock of the lock pin 27 and the engagement hole 29.

Next, a method of assembling the device 8 will be explained. Here, FIG. 1 and FIG. 5 will be referred.

At first, the valve timing control device is arranged at one end of the intake camshaft 2. Here, the lock pin 27 is engaged with the engagement hole 29 to position fixedly the first rotor 13 of the device 8 and the rotor 18 acting as the second rotor at the required angle (the maximum retardation position). In this state, the device 8 is rotatable with respect to the intake camshaft 2.

Next, the sprocket 14 and the rotor 18 fixed to the sprocket 14 at the required angle are fixed by the threaded member 20 to fix indirectly the sprocket 14 to the one end of the intake camshaft 2 at an optional angle.

Next, as shown in FIG. 6, the chain 11 is wound around the sprocket 10, the sprocket 9, and the sprocket 14 while the chain 11 is guided along a first guide rail 45 and a second guide rail 46. The chain 11 is then held under a tension by a chain-tensioner 47 in order to prevent the slack of the chain 11.

Figure 1:
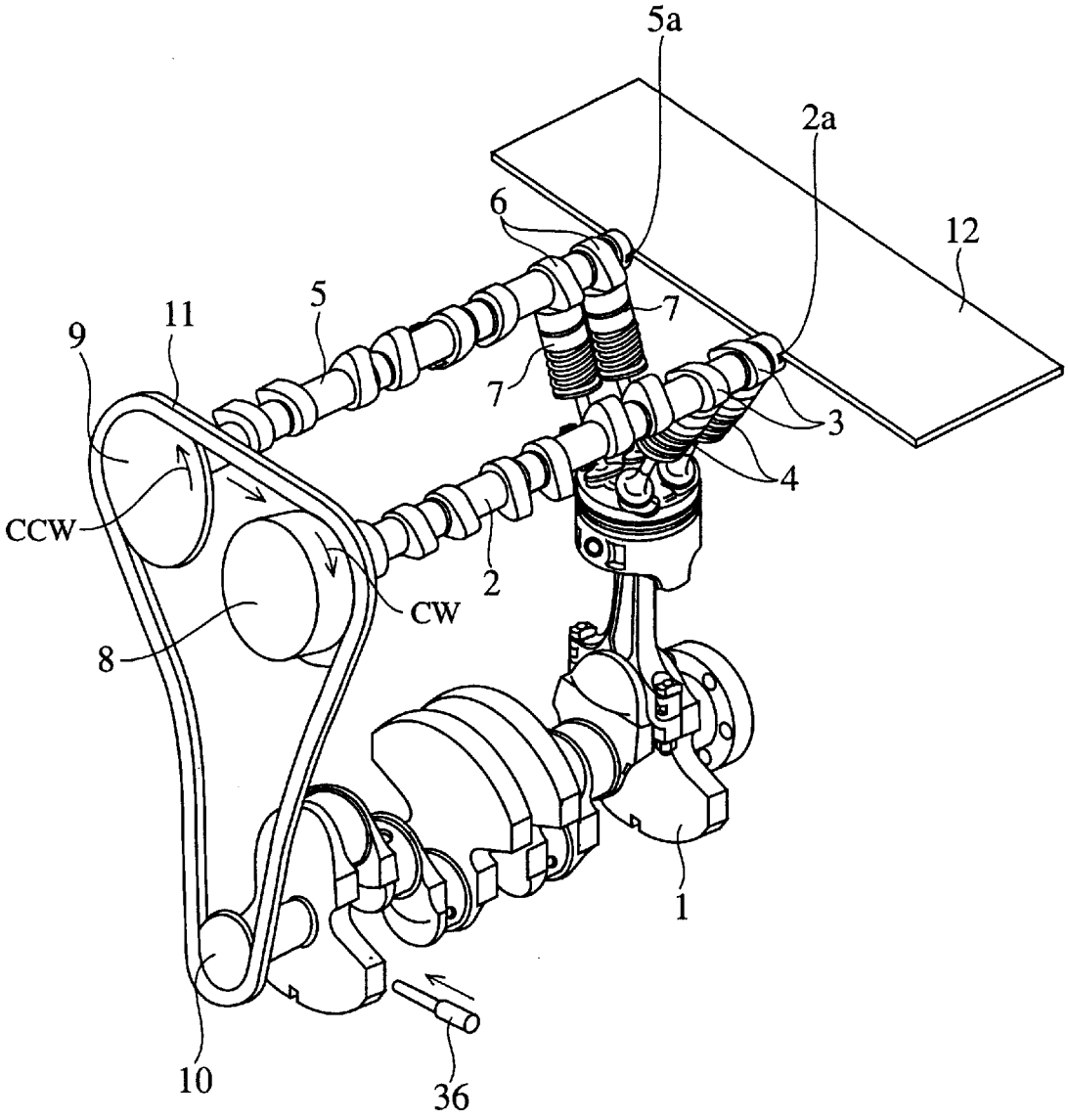
FIG.1 (PRIOR ART)
FIG. 1 is a perspective view of main points of the engine provided with the conventional valve timing control device mounted on an end of an intake cam.

Next, as shown in FIG. 1, the crank-fixing pin 36 is screwed into the crankshaft 1 from the outside of the engine to position the crankshaft 1 at the required angle. The positioning spacer 12 is then inserted into the slit 2*a* of the intake camshaft 2 and the slit 5*a* of the exhaust camshaft 5 to regulate the angle defined between the both camshafts.

Next, the chuck tool of the automatic machine keeps hold of the projection 40 of the device 8. Since the six projections 40 of the embodiment 1 are arranged at regular intervals, the position of the projection 40 can be accurately indexed until the chuck tool rotates through a 60-degree angle.

Next, the sprocket 9 and the projection 40 held by the chuck tool are turned in opposite directions in order to prevent the slack of the chain 11 between the intake camshaft 2 and the exhaust camshaft 5. Concretely, the projection 40 held by the chuck tool is turned clockwise (arrow CW direction of FIG. 1), and the sprocket 9 is turned counterclockwise (arrow CCW direction of FIG. 1). In this state, the sprocket 10 is fixed by a threaded member 48 such as a bolt to the one end of the crankshaft 1, and the sprocket 9 is fixed by a threaded member 49 such as a bolt to the one end of the exhaust camshaft 5.

Here, before fixing the sprocket 9 by the threaded member 49 to the exhaust camshaft 5, the device 8 is fixed by the threaded member 20 to the intake camshaft 20. Assembly errors occur when fitting the conventional device 8 to the engine by the looseness between the lock pin 27 and the engagement hole 29, and between the knock pin 34 of the intake camshaft 2 and the recess 35 of the rotor 18. With the embodiment 1, only the first rotor 13 of the device 8 is turned clockwise by the chuck tool of the automatic machine. Thus, the vane 18*a* of the rotor 18, which acts as the second rotor fixed by the lock pin 27 to the first rotor 13 at the maximum retardation position, can be made with the shoe 15*a* of the case 15 acting as the first rotor 13. Therefore, the device 8 of the embodiment 1 can perform assembly operations with a minimum number of errors, if the looseness is defined between the lock pin 27 and the engagement hole 29.

When the fixation above using the threaded members 20 and 40 is performed, a rotational torque, in the clockwise direction, of the chuck tool must be higher than a rotational torque, in the counterclockwise direction, of the sprocket 9 to do assembly with a minimum number of errors.

As described above, according to the embodiment 1, since the projection 40 is arranged at the first rotor 13, only the first rotor 13 of the device 8 can be turned clockwise by the chuck tool, the device 8 can do assembly with a minimum number of errors. Thus, if the looseness as a clearance necessary to engage is defined between the lock pin 27 and the engagement hole 29, the device 8 can do assembly with a minimum number of errors at the site of assembly, and can be fixed accurately to the intake camshaft 2.

With the embodiment 1, since the device 8 is provided with the first toroidal oil path 42 and the second toroidal oil path 43, the device 8 can be fixed to the intake camshaft 2 at the optional angle to perform a simplification of auto-assembly work.

With the embodiment 1, since the projection 40 is arranged at the first rotor 13, the device 8, which is held by the chuck tool of the automatic machine, can be fixed to the intake camshaft 2. Thus, a time lag in open/close timing of valves owing to a threading torque can be resolved.

With the embodiment 1, it is not necessary to manufacture the knock pins and the recesses arranged at the conventional device and the camshafts, and required with a high positioning accuracy. Thus, the device 8 can be manufactured at a low cost.

With the embodiment 1, since the projection 40 is arranged at the outer portion of the case 15 acting as the first rotor 13, the projection 40 can keep a distance from the inner portion of the case 15 subjected to a hydraulic pressure. Thus, mechanical strength of the case 15 can be maintained.

With the embodiment 1, since the device 8 is provided with the clearance groove 41, the chain 11 can keep from contact with the projection 40 of the sprocket 14 having a small radius to rotate the chain 11 without problems.

Embodiment 2

Figure 7:
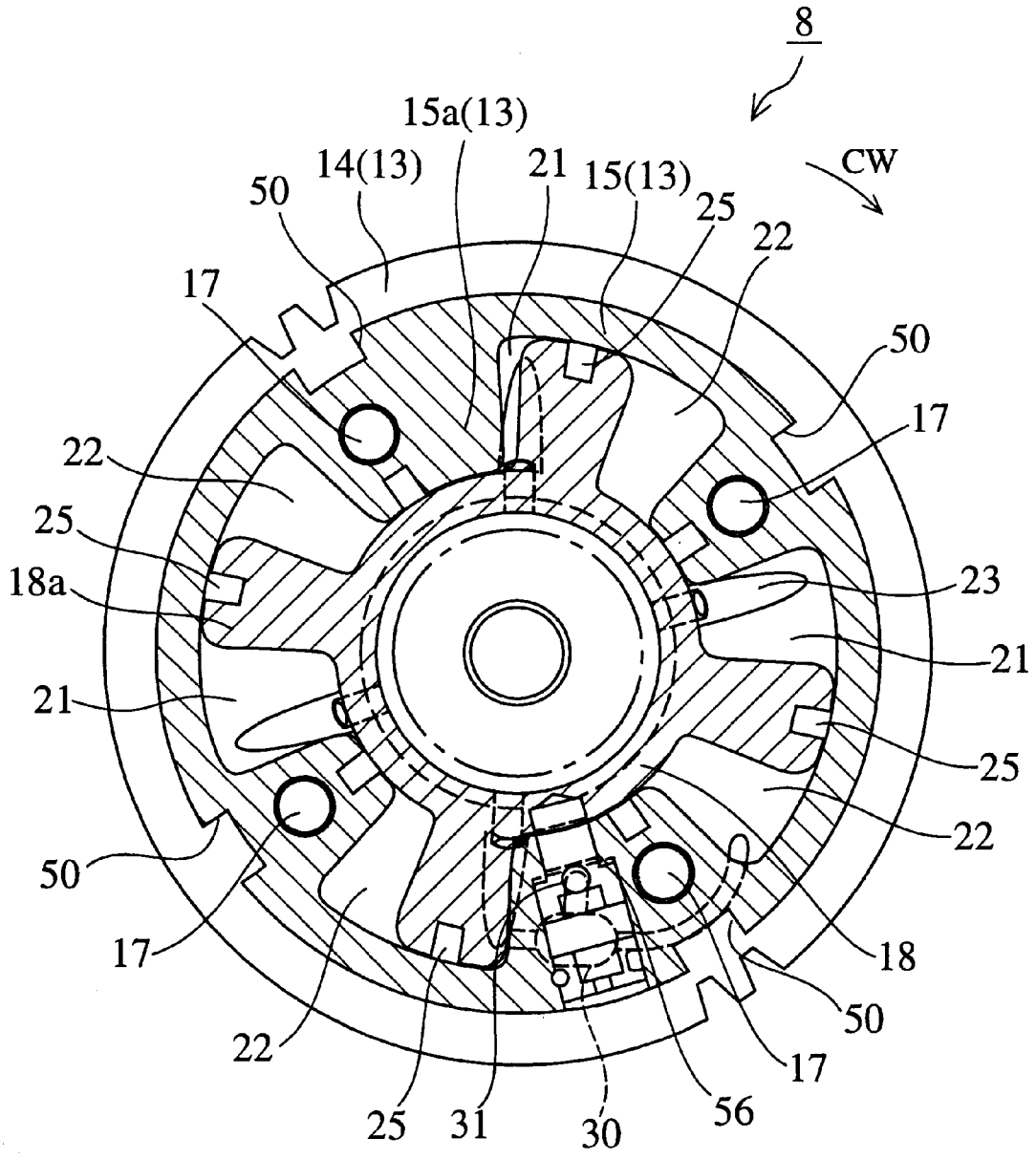
FIG. 7 is a lateral cross sectional view of an internal construction of a valve timing control device as embodiment 2 according to the present invention.

FIG. 7 is a lateral cross sectional view of an internal construction of a valve timing control device as embodiment 2 according to the present invention. In the drawings, since the common numerals of the embodiment 2 denote common elements in the structure of the embodiment 1, the description of such parts is omitted.

The embodiment 2 is characterized in that a plurality (in the embodiment 2, four parts) of concave grooves (chuck site) 50 are arranged at the outer circumferential portion (outer portion) of the case 15 at regular intervals, the respective grooves dented inwardly in the radius direction of the case 15. The concave groove allows the engagement of the chuck tool of the automatic machine used for the auto-assembly work, the chuck tool being operated in the radial direction of the case 15.

As described above, the embodiment 2 can produce the same effect as the embodiment 1 because the embodiment 2 is provided with the concave groove 50 acting as the chuck site.

Embodiment 3

Figure 8:
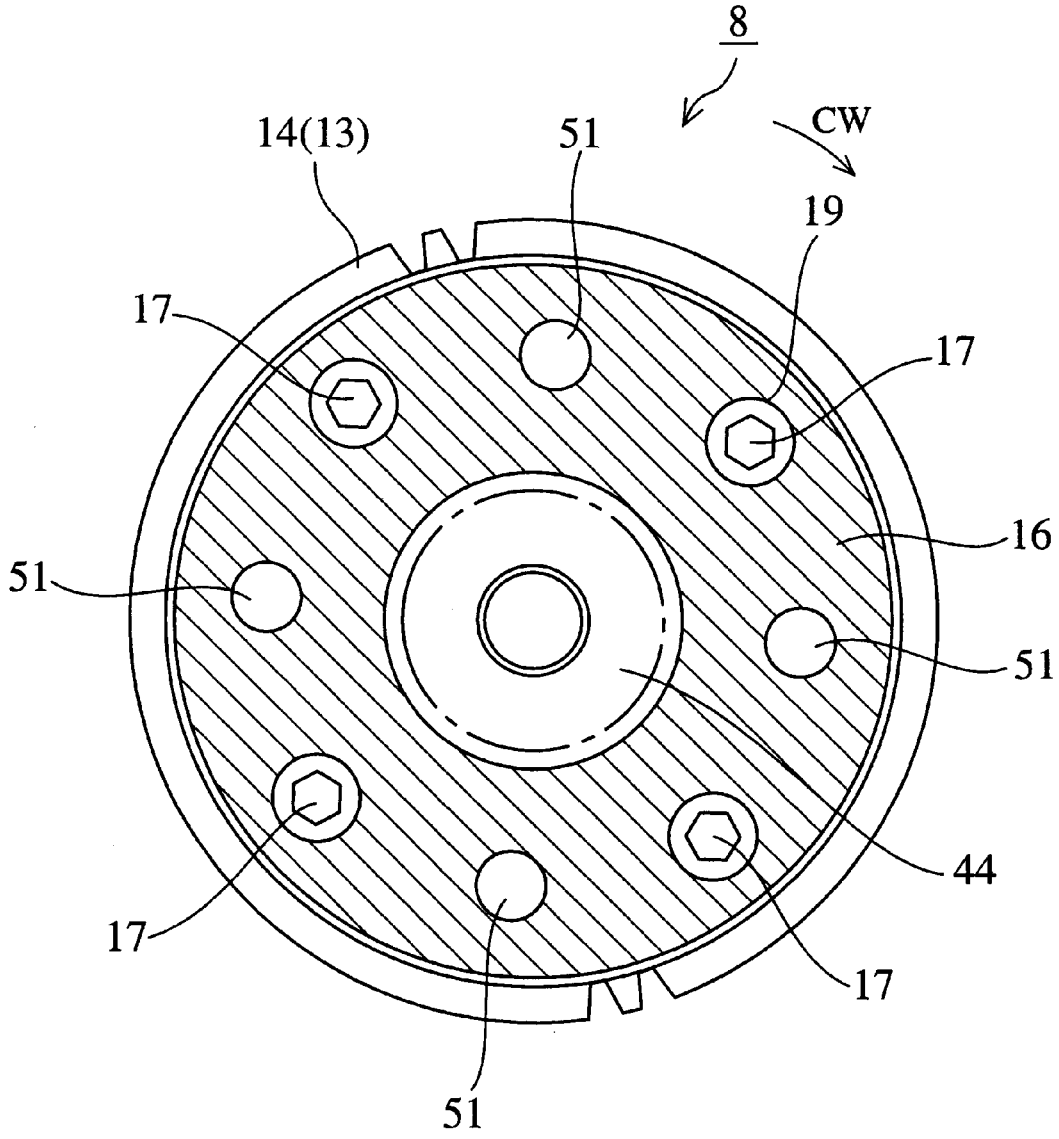
FIG. 8 is a lateral cross sectional view of an internal construction of a valve timing control device as embodiment 3 according to the present invention.

FIG. 8 is e lateral cross sectional view of an internal construction of a valve timing control device as embodiment 3 according to the present invention. In the drawings, since the common numerals of the embodiment 3 denote common elements in the structure of the embodiment 1 and so on, the description of such parts is omitted.

The embodiment 3 is characterized in that a plurality (in the embodiment 3, four parts) of concave holes (chuck site) 51 are arranged at the cover 16 acting as the first rotor 13 at regular intervals, the respective holes dented in an axial direction of the cover 16.

As described above, the embodiment 3 can produce the same effect as the embodiment 1 because the embodiment 3 is provided with the concave hole 51 acting as the chuck site.

Moreover, with the embodiment 3, when the cover 16 is made of thin material being low in strength, a head (in the embodiment 3, a hexagonal, concave hole) of the threaded member 17 may be used as the chuck site.

Embodiment 4

Figure 9:
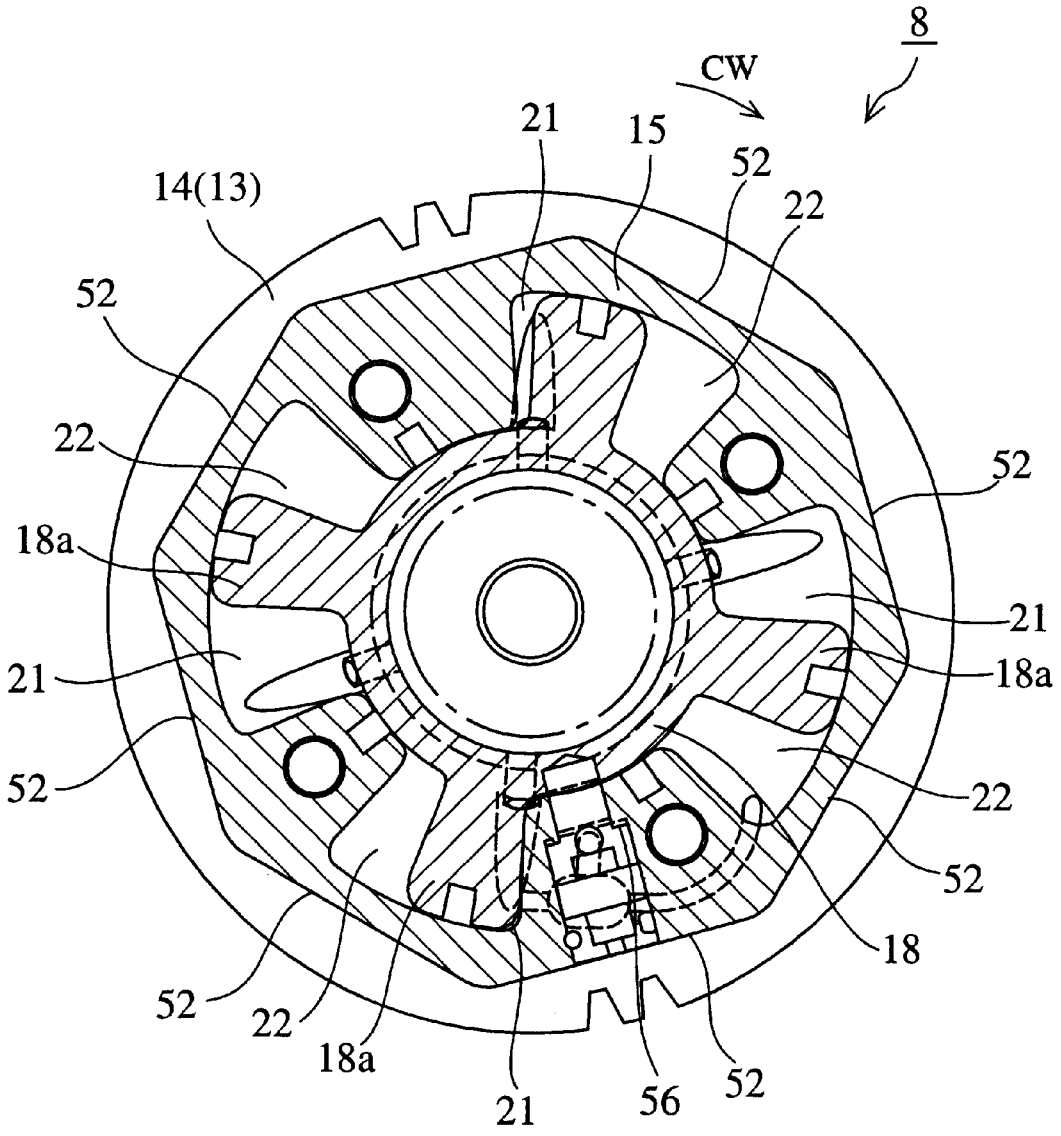
FIG. 9 is a lateral cross sectional view of an internal construction of a valve timing control device as embodiment 4 according to the present invention.

FIG. 9 is a lateral cross sectional view of an internal construction of a valve timing control device as embodiment 4 according to the present invention. In the drawings, since the common numerals of the embodiment 4 denote common elements in the structure of the embodiment 1 and so on, the description of such parts is omitted.

The embodiment 4 is characterized in that a polygonal (in the embodiment 4, an octagon) portion (chuck site) 52 is arranged at the outer portion of the case 15 acting as the first rotor 13, the polygonal portion 52 having a combination of corner parts and plane parts.

As described above, with the embodiment 4, the polygonal portion 52 is arranged at the case 15. Thus, a simplification of the shape of the case 15 acting as the first rotor 13 can be performed. Since the polygonal portion 52 acting as the chuck site is arranged at a position keeping a distance from an inner portion subjected to a hydraulic pressure, the first rotor 13 can maintain high mechanical strength.

Embodiment 5

Figure 10:
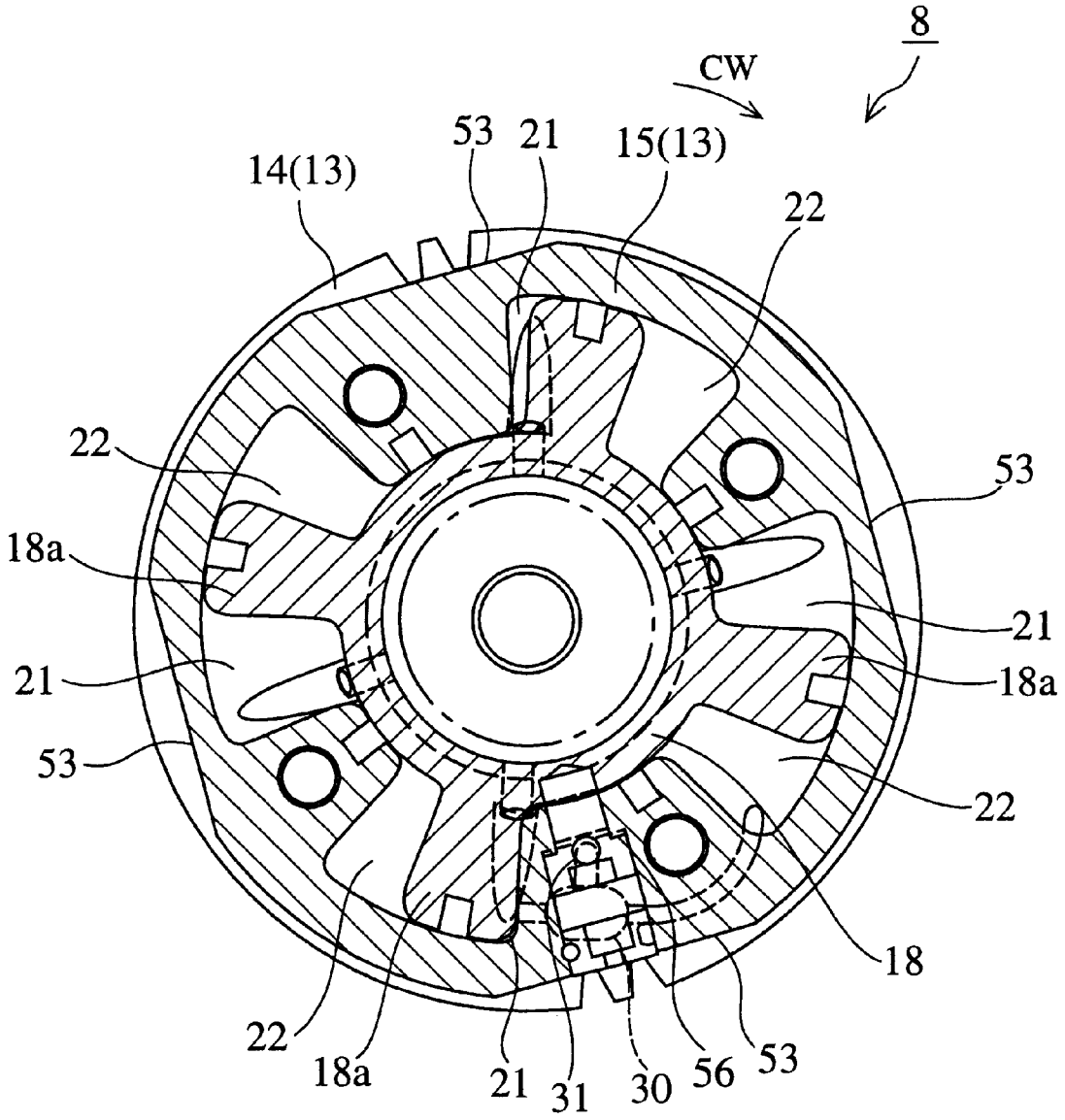
FIG. 10 is a lateral cross sectional view of an internal construction of a valve timing control device as embodiment 5 according to the present invention.

FIG. 10 is a lateral cross sectional view of an internal construction of a valve timing control device as embodiment 5 according to the present invention. In the drawings, since the common numerals of the embodiment 5 denote common elements in the structure of the embodiment 1 and so on, the description of such parts is omitted.

The embodiment 5 is characterized in that a plurality (in the embodiment 5, four parts) of plane portions (chuck sites) 53 are arranged at the outer circumferential portion (outer portion) of the first rotor 13 at regular intervals.

As described above, the embodiment 5 can produce the same effect as the embodiment 1 because the embodiment 5 is provided with the plane portions 53 acting as the chuck site.

Embodiment 6

Figure 11:
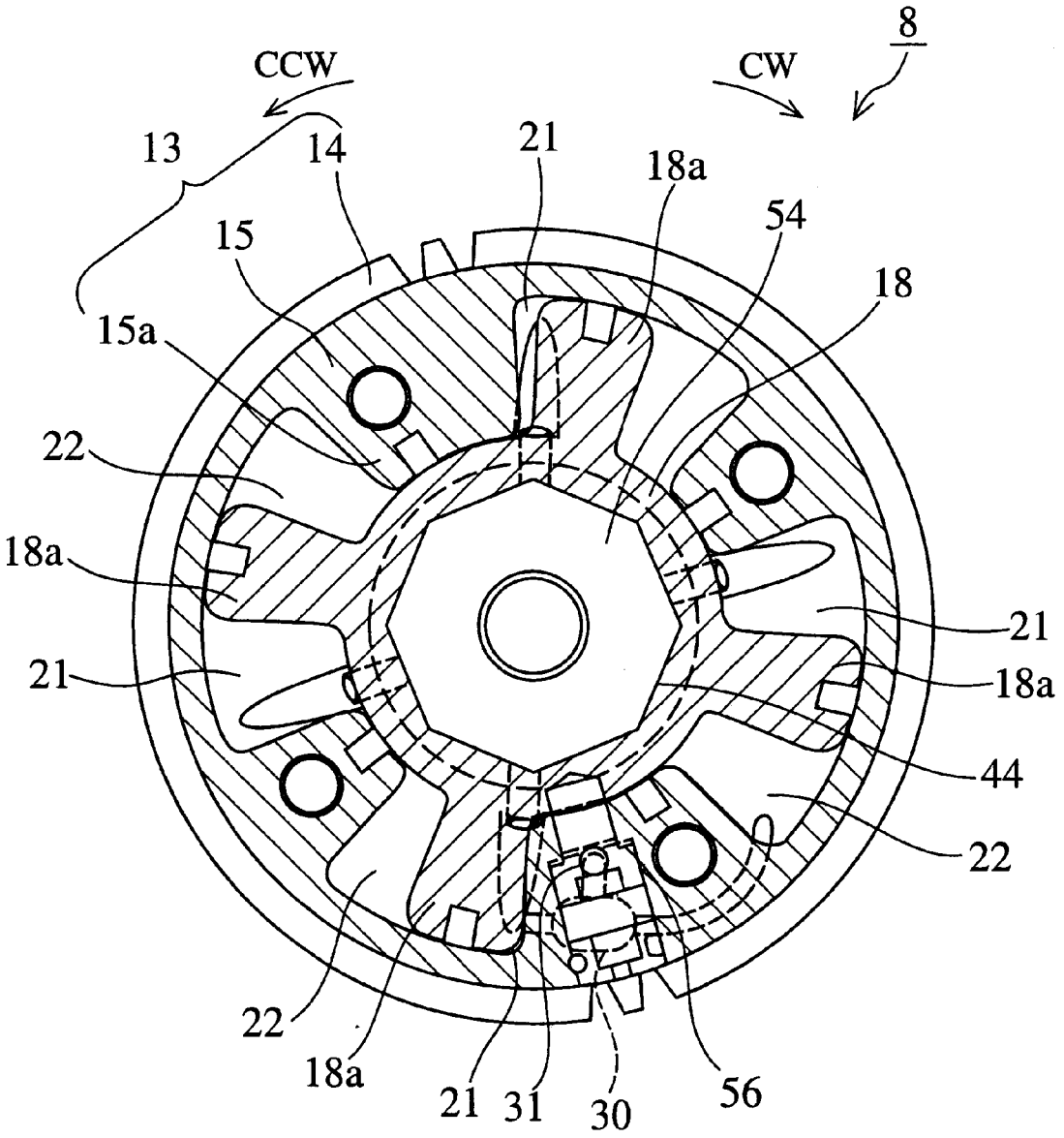
FIG. 11 is a lateral cross sectional view of an internal construction of a valve timing control device as embodiment 6 according to the present invention.

FIG. 11 is a lateral cross sectional view of an internal construction of a valve timing control device as embodiment 6 according to the present invention. In the drawings, since the common numerals of the embodiment 6 denote common elements in the structure of the embodiment 1 and so on, the description of such parts is omitted.

The embodiment 6 is characterized in that a polygonal portion (in the embodiment 6, an octagonal portion (chuck site) 52 is arranged at an inner face of the concave seat 44 arranged at the rotor 18 acting as the second rotor.

With the embodiment 6, the device 8 can be held through the concave seat 44 by the chuck tool of the automatic machine when the device 8 is fitted to the intake camshaft 2 of the engine, for example. Thus, when the first rotor 13 is turned clockwise, the second rotor 18 can be held at the angle to avoid the turning clockwise of the second rotor 18. Therefore, the second rotor 18 can position with respect to the first rotor 13 at the maximum retardation position, for example.

In the case that the device 8 of the embodiment 6 is fitted to the exhaust camshaft 5, the concave seat 44 of the second rotor 18 is turned counterclockwise to position the second rotor 18 with respect to the first rotor 13 at the maximum retardation position.

As described above, the embodiment 6 can produce the same effect as the embodiment 1 because the polygonal portion 54 is arranged at the second rotor 18. Moreover, the chuck tool of the automatic machine can be arranged on an axis of a threaded tool of the threaded member 20 to downsize production tooling.

Embodiment 7

Figure 12:
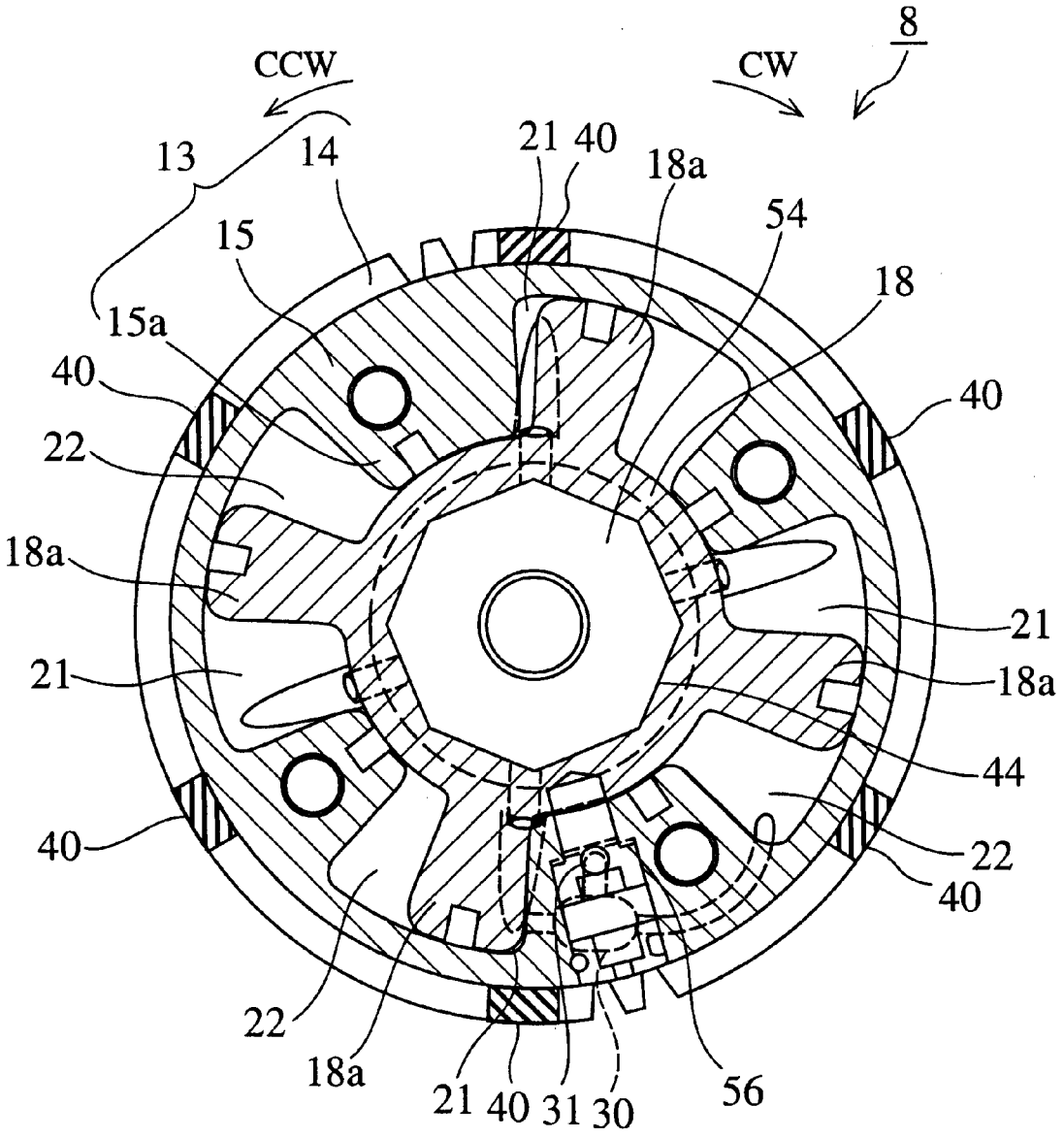
FIG. 12 is a lateral cross sectional view of an internal construction of a valve timing control device as embodiment 7 according to the present invention.

FIG. 12 is a lateral cross sectional view of an internal construction of a valve timing control device as embodiment 7 according to the present invention. In the drawings, since the common numerals of the embodiment 7 denote common elements in the structure of the embodiment 1 and so on, the description of such parts is omitted.

The embodiment 7 is characterized in that the device 8 is provided with both the projections 40 of the embodiment 1 and the polygonal portion 54 of the embodiment 6.

In the case that the device 8 of the embodiment 7 is fitted to the intake camshaft 2, for example, and that the sprocket 9 is fitted to the exhaust camshaft 5, the first rotor 13 is turned clockwise while turning counterclockwise the rotor 18 acting as the second rotor. Thus, the slack of the chain 11 between both camshafts can be prevented without fitting the device 8 to the engine before fitting the sprockets 9 and 10 thereto as described in the embodiments 1 to 6. Here, with the intake camshaft 2, the vane 18*a* of the second rotor 18 can come into firm contact with the shoe 15*a* of the first rotor 13 at the maximum retardation position. Thus, the device 8 can perform assembly operations with a minimum number of errors.

As described above, the embodiment 7 can produce the same effect as the embodiment 1 because the embodiment 7 is provided with the projection 40 and the polygonal portion 54, which act as the chuck site. Moreover, the chuck tool of the automatic machine can be arranged on an axis of a threaded tool of the threaded member 20 to downsize production tooling.

Embodiment 8

Figure 13:
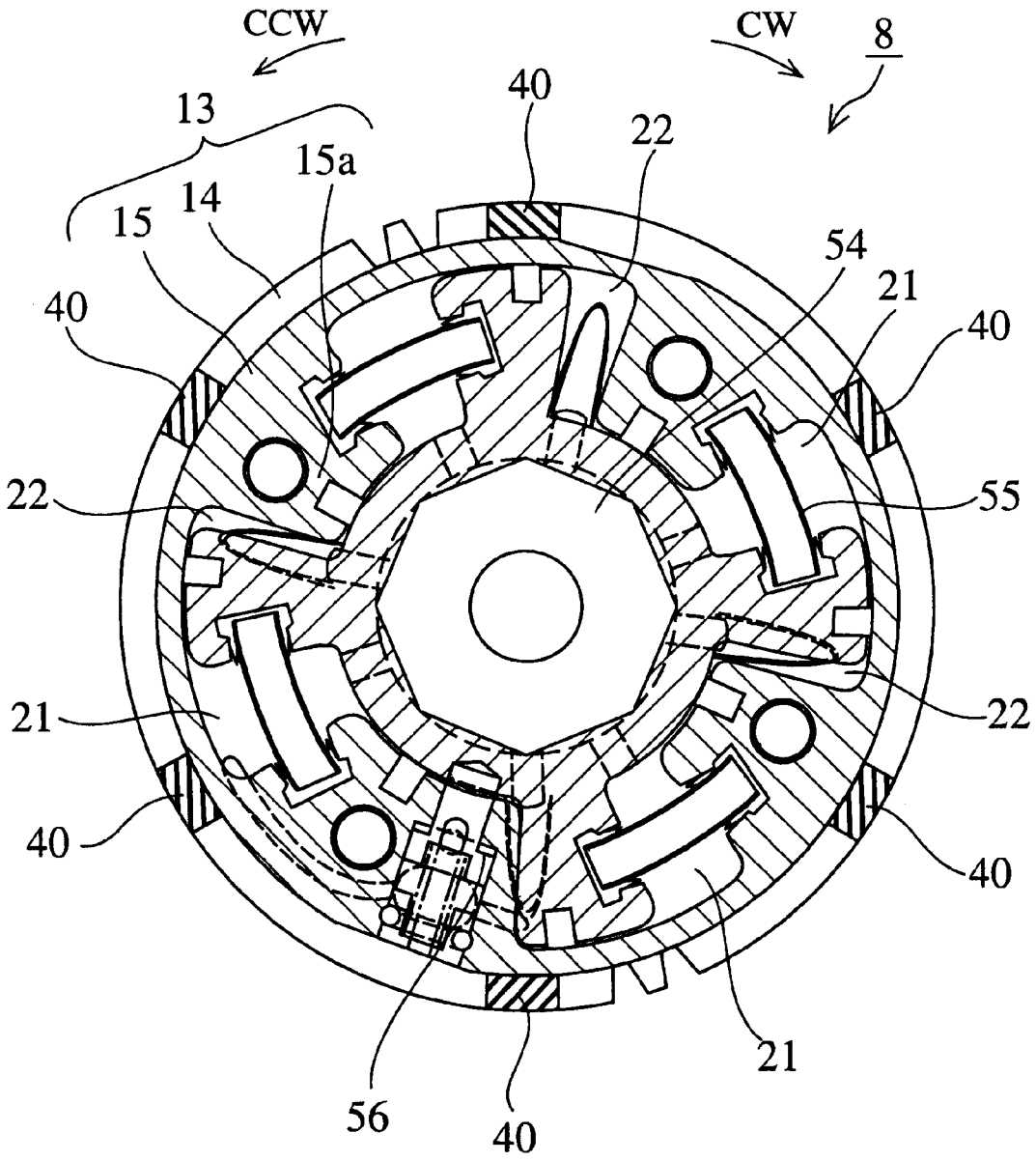
FIG. 13 is a lateral cross sectional view of an internal construction of a valve timing control device as embodiment 8 according to the present invention.

FIG. 13 is a lateral cross sectional view of an internal construction of a valve timing control device as embodiment 8 according to the present invention. In the drawings, since the common numerals of the embodiment 8 denote common elements in the structure of the embodiment 1 and so on, the description of such parts is omitted.

The embodiment 8 is characterized in that the device 8 is provided with both the projections 40 of the embodiment 1 and the polygonal portion 54 of the embodiment 6. Moreover, a biasing member 55 is arranged in the advance side hydraulic pressure chamber 21, the biasing member 55 biasing the rotor 18 acting as the second rotor with respect to the first rotor 13 toward the maximum advance side. When the second rotor 18 positions at the maximum advance side, the lock member regulates free rotation between the first rotor 13 and the second rotor 18.

When the device 8 of the embodiment 8 is fitted to the exhaust camshaft 5, for example, and any device of the embodiments 1 to 5 is fitted to the intake camshaft 2, the following steps are performed to prevent slack in the chain 11 between both camshafts. At first, the sprocket 14 and therotor 18 fixed to the sprocket 14 at the required angle are fixed by the threaded member 20 to fix indirectly the sprocket 14 to one end of the intake camshaft 2. Next, the first rotor 13 of the device 8 fixed to the intake camshaft 2 and the second rotor 18 of the device 8 fixed to the exhaust camshaft 5 are turned clockwise. At the same time, the first rotor 13 of the device 8 fixed to the exhaust camshaft 5 is turned counterclockwise. Here, the vane 18*a* of the second rotor 18 can come into firm contact with the shoe 15*a* of the first rotor 13 at the maximum retardation position of the intake camshaft 2 or at the maximum advance position of the exhaust camshaft 5. Thus, both the devices 8 can perform assembly operations with a minimum number of errors.

When the device 9 of the embodiment 8 is fitted to the exhaust camshaft 5, for example, and any device 8 of the embodiments 1 to 5 is fitted to the intake camshaft 2, the following steps are performed to prevent the slack of the chain 11 between both camshafts 2 and 5. The first rotor 13 of the device 8 fixed to the intake camshaft 2 and the second rotor 18 of the device 9 fixed to the exhaust camshaft 5 are turned clockwise. At a time, the second rotor 18 of the device 8 fixed to the intake camshaft 2 and the first rotor 13 of the device 9 fixed to the exhaust camshaft 5 are turned counterclockwise. Here, the vane 18*a* of the second rotor 18 can come into firm contact with the shoe 15*a* of the first rotor 13 at the maximum retardation position of the intake camshaft 2 or at the maximum advance position of the exhaust camshaft 5. Thus, both the devices 8 and 9 can perform assembly operations with a minimum number of errors.

As described above, the embodiment 8 can produce the same effect as the embodiment 1 because the embodiment 8 is provided with the projection 40 and the polygonal portion 54, which act as the chuck site. Moreover, the chuck tool of the automatic machine can be arranged on an axis of a threaded tool of the threaded member 20 to downsize production tooling.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device acting as an actuator, comprising:

a first rotor rotating in synchronization with a crankshaft of an internal combustion engine, the first rotor having a plurality of shoes inside thereof;

a second rotor fixed on an end of an intake camshaft or an exhaust camshaft of the internal combustion engine and arranged rotatably in the first rotor, the second rotor having a plurality of vanes on the outside;

an advance side hydraulic pressure chamber and a retardation side hydraulic pressure chamber defined between the vanes of the second rotor and the shoes of the first rotor;

a lock member locking the first and second rotors at a required angle which the second rotor forms with the first rotor; an engagement hole arranged at any one of the first and second rotors to allow insertion of the lock member; and a chuck site being chucked by a chucking tool used for fitting the actuator to the engine, which is arranged at least one on the first rotor or on the second rotor.

2. A valve timing control device according to claim 1, wherein the chuck site is arranged on the first rotor, allowing the engagement of the chucking tool which is operated in a radial direction of the first rotor.

3. A valve timing control device according to claim 2, wherein the chuck site is arranged at an outer circumferential portion of the first rotor.

4. A valve timing control device according to claim 1, wherein the chuck site is arranged on the first rotor, allowed to insert the chucking tool which is operated in an axial direction of the first rotor.

5. A valve timing control device according to claim 4, wherein the chuck site is a bolt head used for assembling the actuator.

6. A valve timing control device according to claim 1, wherein the chuck site is arranged on the outer circumferential portion of the first rotor, and has a polygonal shape.

7. A valve timing control device according to claim 1, wherein the chuck site is arranged on the outer circumferential portion of the first rotor, and includes at least one plane.

8. A valve timing control device according to claim 1, wherein the chuck site supports the first rotor or the second rotor in a rotational direction thereof.

9. A valve timing control device according to claim 1, wherein the chuck site is arranged on the outer circumferential portion of the first rotor, and has a groove to separate the chuck site from an endless transfer member transferring rotation of the crankshaft.

10. A valve timing control device according to claim 1, wherein the chuck site is arranged on the inner circumferential portion of the second rotor, and has a polygonal shape.

11. A valve timing control device according to claim 1, wherein the chuck site is arranged on the second rotor, allowing the engagement of the chucking tool which is operated in a radial direction of the second rotor.

12. A valve timing control device according to claim 1, wherein the chuck site is arranged on the second rotor, allowed to insert the chucking tool which is operated in an axial direction of the second rotor.

* * * * *